US005609307A

United States Patent [19]

Rota

[11] Patent Number: 5,609,307

[45] Date of Patent: Mar. 11, 1997

[54] SHREDDING APPARATUS WITH ROTATING ROLLERS EQUIPPED WITH NON-PERFORATED CURVED PLATES COAXIAL WITH THE ROLLERS

[75] Inventor: Fabio Rota, Milan, Italy

[73] Assignee: Satrind s.r.l., Milan, Italy

[21] Appl. No.: 394,263

[22] Filed: Feb. 22, 1995

[30] Foreign Application Priority Data

Mar. 10, 1994 [IT] Italy ..... MI94A0444

[51] Int. Cl.[6] ..... B02C 18/22

[52] U.S. Cl. ..... 241/73; 241/166; 241/236

[58] Field of Search ..... 241/236, 166, 241/167, 73

[56] References Cited

U.S. PATENT DOCUMENTS

| | | | |
|---|---|---|---|
| 3,664,592 | 5/1972 | Schweigert et al. | 241/73 |
| 4,385,732 | 5/1983 | Williams | 241/73 X |
| 4,693,428 | 9/1987 | Raterman et al. | 241/167 |
| 5,232,510 | 8/1993 | Tilbey | 241/167 X |
| 5,275,342 | 1/1994 | Galanty . | |

FOREIGN PATENT DOCUMENTS

| | | |
|---|---|---|
| WO88/01201 | 2/1988 | European Pat. Off. . |
| 2474341 | 7/1981 | France . |
| 1914781 | 10/1970 | Germany . |
| 3430087 | 2/1986 | Germany . |
| MI93A1736 | 1/1995 | Italy . |
| 57949A | 5/1969 | Luxembourg . |
| 1454288 | 11/1976 | United Kingdom . |
| 2059804 | 4/1981 | United Kingdom . |

*Primary Examiner*—Mark Rosenbaum
*Attorney, Agent, or Firm*—Burns, Doane Swecker & Mathis LLP

[57] ABSTRACT

A shredding apparatus includes rotating shredder rollers with parallel axes. Each roller is formed by numerous toothed discs with spaces between the discs. Two or more of the rollers are cooperating rollers with the discs of the cooperating rollers being offset so that the discs of each of the cooperating rollers can enter the spaces between the discs of another one of the cooperating rollers. Some of the rollers cooperate with curved grid sectors that are coaxial with the rollers. Curved, non-perforated and/or perforated plate sectors are coaxial with a pair of cooperating rollers rotating in opposite directions, the plate sectors being coaxial with and having a greater radius than the cooperating rollers and extending around the cooperating rollers for an arc. Blades are provided along one or more edges between the perforated and/or plate sectors.

10 Claims, 1 Drawing Sheet

SHREDDING APPARATUS WITH ROTATING ROLLERS EQUIPPED WITH NON-PERFORATED CURVED PLATES COAXIAL WITH THE ROLLERS

BACKGROUND OF THE INVENTION

The invention relates to the field of apparatus grinding or shredding material such as wood, refuse, paper etc.

Various apparatus are known for this purpose, generally comprising a plurality of rollers rotating in opposite directions, each made up of discs with rigid teeth, spaced out axially from one another on a drive shaft; the drive shafts are generally parallel and set at such a distance from each other as to allow the rollers to intersect. The teeth on the rollers of each axle are generally offset.

In particular EP 0319535 discloses a shredding apparatus with four rollers, namely two lower main rollers rotating in opposite directions, with their axles in a horizontal plane, and two outer side rollers, each cooperating with one of the main rollers. Beneath the rollers extends a grid or screen made up of perforated plates curved to the shape of a cylindrical surface, joined together and having as their axes the roller axes. This apparatus, though providing good results, requires a relatively high investment cost and has a high power consumption and in any case does not guarantee that there will not be occasional long pieces in the product leaving the shredder, especially in the case of wood.

Apparatus with two cooperating rollers, in which the shafts of the two rollers turn at different speeds, are also know to the art. In these apparatus it is common experience that, unless special measures are taken, a deposit of material forms between the disk type blades of the fastest shaft, and the slower shaft cannot clear this deposit. If left in place, the deposit builds-up, becomes compressed and hardens to the point of breaking the apparatus. The twin-shafted apparatus available on the market generally comprise cleaning sections fixed to the frame and protruding between the blades of the fast shaft, which remove the deposit as it forms. These cleaning sectors generally extend for about 90° around the shaft of the relative roller. However, this arrangement does not allow a grille or grid to be used beneath the rollers since the material that is continually removed is pushed downward and, not always being of the right size to pass through the grille, it would accumulate against the grille itself to the point of breaking it.

A previous application by the same applicant, No. MI 93 A 001736, provides for a shredding apparatus with three roller of which the main two rotate in opposite directions at different speeds whilst a side roller cooperates with the faster of the pair of main rollers and rotates concordantly with it.

The inventor has noted that in the shredding apparatus outlined above it is possible for some relatively stiff shredded parts that have two dimensions smaller than the size of the holes in the grille to pass through said grille even if their third dimension is greater than the size of the holes in the grille, since said parts come to be disposed at right angles to the surface of the grille and are pushed through it in this position.

OBJECTS AND SUMMARY

An aim of this invention is to overcome this drawback, thus improving the performance of the apparatus.

According to the invention, it has been found that if, instead of a curved grille coaxial with the rollers, a non-perforated plate also coaxial with the rollers is disposed under the lower rollers rotating in opposite directions, or at least under a portion of them, the performance of the apparatus is improved, making it possible to obtain a more uniform product size.

In particular, the non-perforated plate is situated at that outer portion of the rollers rotating in opposite directions where the shredded product leaves the area of cooperation between these rollers.

According to a further characteristic of the invention, blades are disposed along at least some of the edges/brined by the curved sections of perforated or non-perforated plate, to cooperate with the rollers. In particular the blades are set in the edges coinciding with the areas in which rollers rotating in the same direction cooperate.

In particular, according to the invention, in an apparatus with three rollers, two lower rollers rotating in opposite directions and a third upper roller, the pre-formed curved solid plate extends along and around the lower portion of the slower of the lower rollers, at a distance from it, and also partially around that portion of the faster of the pair of lower rollers that is situated in proximity to the slower roller.

BRIEF DESCRIPTION OF THE DRAWINGS

Exemplary, non-restrictive embodiments of the invention will be described below with reference to the attached drawings in which they are illustrated and in which.

DETAILED DESCRIPTION OF THE DRAWINGS

Figure 1:
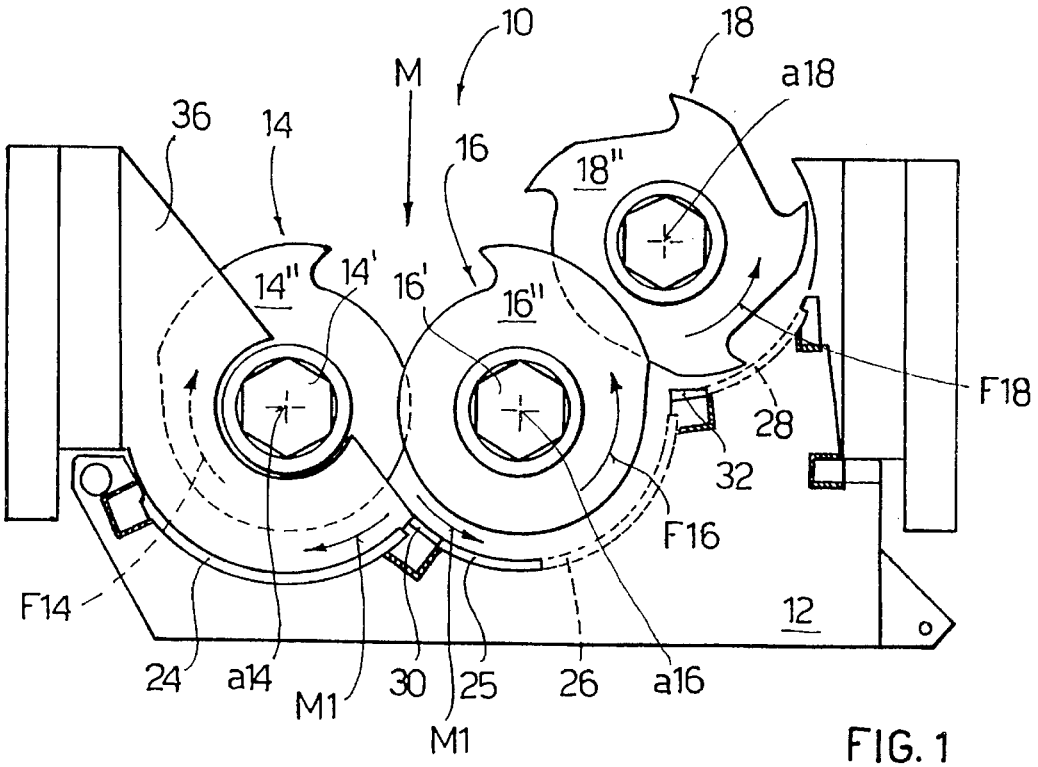
FIG. 1 is a schematic section, in a plane at right angles to the roller axes, of a first example of a shredding apparatus with three shredding rollers.

With reference firstly to FIG. 1, an apparatus 10 according to this invention comprises, on a structure 12, three grinding or shredding rollers, 14, 16 and 18, respectively, with parallel horizontal axes, respectively $a_{14}$, $a_{16}$ and $a_{18}$. Each roller, in a per se known way, is composed of a rotating drive shaft 14', 16' and 18' on which axially spaced out disc type blades 14", 16" and 18" are fixed, each having one or more teeth. The disc type blades of adjacent rollers are offset with respect to each other, so that each disc blade of a roller can enter the space between two consecutive blades of the roller with which it cooperates.

Each blade is shaped with one or more projecting cutting teeth.

The two rollers 14, 16 turn in the opposite direction and, in particular, the roller 14 turns clockwise (from the viewing point of FIG. 1) in the direction of the arrow $F_{14}$ and the roller 16 turns anti-clockwise in the direction of the arrow $F_{16}$. The speed of rotation of the roller 16 is appreciably higher than that of the roller 14.

The side roller 18 is preferably disposed with its axis to the side of and above the roller 16; the direction of rotation of the roller 18 is anti-clockwise in the figure in the direction of the arrow $F_{18}$, i.e. in the same direction as the roller 16 with which the roller 18 cooperates, and the speed of the roller 18 is higher than that of the roller 16.

Beneath the roller 14 is disposed a sector of curved non-perforated plate 24 according to a section of cylindrical surface with an axis $a_{14}$ and a larger radius than the greatest radius of the roller 14, so that it is at a distance from the roller. Beneath the roller 16 extends a cylindrical sector 25 of non-perforated plate and adjacent to it in the direction of the circumference, a sector 26 of perforated plate or grille, these sectors forming an arc of a circle, as viewed in FIG. 1, around the axis $a_{16}$ of the roller 16 and at a distance it. Obviously in place of the non-perforated or perforated plate it is possible to use any other type of material, non-perforated or perforated.

Beneath the roller 18 extends a perforated plate sector 28.

At the edge between the plates 24, 25 reference number 30 indicates a plate fixing slab. At the edge between the plates 26, 28 a further longitudinal blade 32 is provided, that is thus disposed at the area of cooperation between the rollers 16 and 18 which rotate in the same direction.

A system of cleaning sectors 36, fixed to the frame of the apparatus, cooperates with the slower roll 14 of the pair of cooperating rollers 14, 16 and has a comb-like arrangement, so that each sector enters the space between two adjacent discs of the roller 14. Each cleaning sector extends around the shaft of the roller 14 for an arc of about 260°.

The material to be shredded is conveyed in the direction of the arrow M into the area of cooperation between rollers 14 and 16, where it undergoes a first cutting. On leaving said area most of it is deviated by the sectors 36 and the plate 25 in the direction of the arrow M', so that part of it passes through 26 and the part that is not of a sufficiently small size is carried to the area of cooperation between the rollers 16 and 18, which rotate in the same direction, where it is further shredded between said rollers and against the fixed blade 32.

Figure 2:
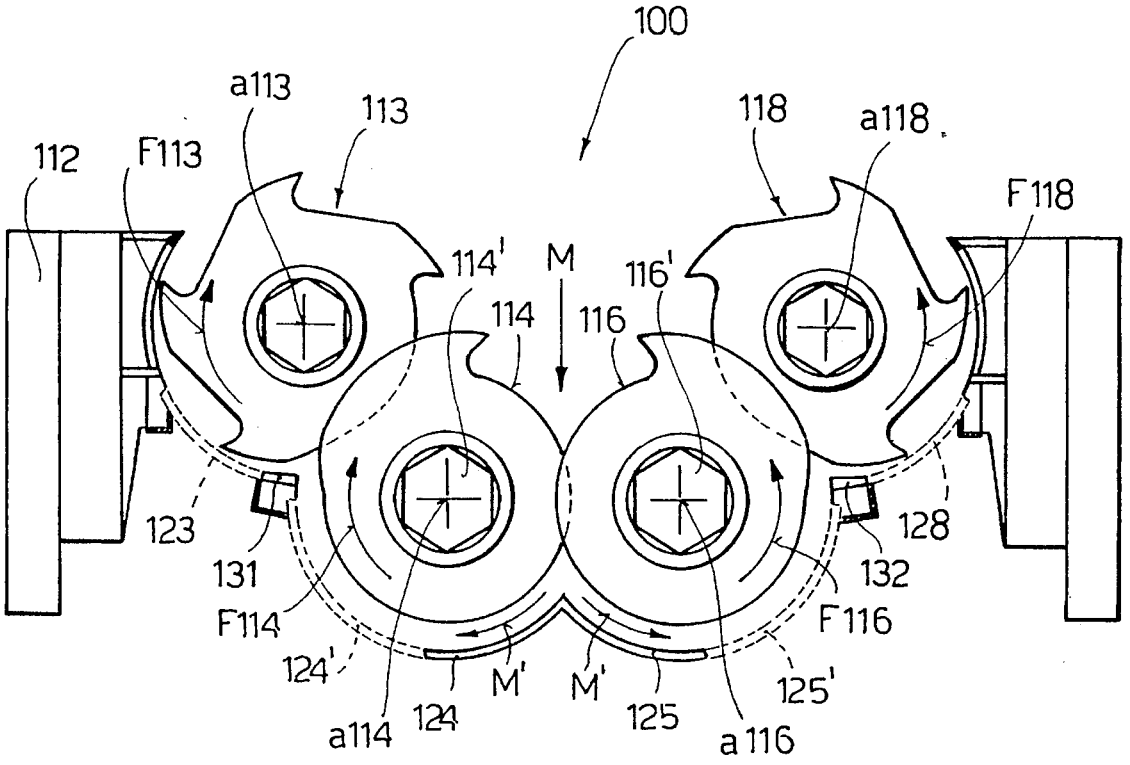
FIG. 2 is a schematic section, in a plane at right angles to the roller axes, of a second example of a shredding apparatus with four cooperating rollers.

In FIG. 2 a second embodiment of the apparatus according to the invention can be seen, indicated as whole by reference number 100. The apparatus 100 comprises, on a structure 112, a pair of lower rollers rotating in opposite directions indicated by 114 and 116, each comprising, on a respective shaft 114', 116', a plurality of parallel toothed discs, and a pair of side rollers 113, 118, disposed with the relative axes $a_{113}$, $a_{118}$ in a position above and to the side of the axes $a_{114}$, $a_{116}$ of the rollers 114, 116. The roller 113 rotates in the direction of the arrow $F_{113}$ concordantly with the roller 114 with which it cooperates; the roller 118 rotates in the direction of the arrow $F_{118}$ concordantly with the direction of rotation (arrow 116) of the roller 116.

Coinciding with the intake space between the rollers 114, 116 and beneath it a double sector of non-perforated plate, 124, 125, extends tier an arc of a circle in FIG. 2 (i.e. shaped like a cylindrical sector) from about 15° to 40° beneath the roller 114 and for the same amount under the roller 125. Sectors of perforated plate or grille, 124' and 125' respectively, are disposed adjacent to said sectors of non-perforated plate, so that the sector 124 and the sector 124' form a cylinder sector around the axis $a_{114}$ of the roller 114, with a greater radius than said roller, and the sector 125 plus the sector 125' form a cylinder sector or part of a cylindrical surface around the axis $a_{115}$ and having a greater radius than the radius of the roller 116.

Beneath the roller 113 extends a portion of perforated plate with a cylindrical surface with a slightly greater radius than the maximum radius of the roller 113. Likewise, beneath the roller 118 extends a cylindrical portion of perforated plate with a slightly greater radius than that of the roller 118 with which it is concentric. A longitudinal blade is provided at the edge between the perforated plates 123, 124'; a longitudinal blade 132 is provided at the edge between the grilles 125' and 128 . It will be noted that each blade 131, 132 is situated at area of cooperation between rollers rotating in the same direction.

The material introduced into the shredding apparatus is first poured into the area between rollers 114 and 116, in the direction of the arrow M, and undergoes a first shredding between them, then it is deviated along sectors 124, 125 in the direction of the arrows M'. That part of the material which is of a sufficiently small size after shredding passes through the grille sectors 124', 125' while the remaining material is carried for treatment to the engagement area between the discs of the rollers 116 and 118 and against the blade 132 and respectively between the discs of the rollers 113 and 114, and against the blade 131, and there undergoes further shredding, then being carried back against the grille 123 and 128, respectively. The material that is still not fit to pass through the grille at this point is carried back upwards into the area between the teeth of the rollers 113 and 118 and the fixed structure 112, and returned into the shredding area between the rollers 113, 114 and 116, 118, respectively.

The new apparatus obtains a product of more uniform size than those of the previous art.

I claim:

1. An apparatus for shredding material comprising:

a frame, rotating shredding rollers with a substantially horizontal axis within the frame, the rollers comprising toothed disk type blades spaced out axially along drive shafts, at least two of the rollers cooperating with each other such that, for each one of the at least two cooperating rollers, blades thereof enter into spaces between two blades of another one of the at least two cooperating rollers, a grille beneath at least the at least two cooperating rollers, at a distance from and coaxial therewith, the grille comprising axially extending portions of non-perforated plate and one or more axially extending portions of perforated plate, adjacent to the non-perforated portions, disposed beneath a portion of the at least two cooperating rollers, at a distance from edges of the at least two cooperating rollers and having curved surfaces coaxial with the at least two cooperating rollers, the non-perforated portions extending beneath at least one of the at least two cooperating rollers through an arc of at least 30°, wherein the rollers include three rollers with parallel axes, two of the rollers being cooperating rollers rotating in opposite directions, rotating at different speeds from each other and a third of the rollers being situated above and to a side of a faster of the two cooperating rollers, wherein the non-perforated portions are situated beneath the slower of the two cooperating rollers and beneath a portion of the faster of the two cooperating rollers, and wherein the whole portion beneath the slower roller of the at least two cooperating rollers is non-perforated.

2. A shredding apparatus according to claim 1, wherein the non-perforated portions are disposed at an outlet of a first shredding area between the at least two cooperating rollers rotating in opposite directions.

3. An apparatus according to claim 1, wherein the curved surfaces of the non-perforated portions and the perforated portions have the same radius of curvature as one another.

4. An apparatus according to claim 1, further comprising fixed cleaning sectors extending for an arc into the spaces between the blades of the two cooperating rollers.

5. An apparatus according to claim 4, wherein each cleaning sector extends for about 260°–270° around the axis of the slower roller.

6. An apparatus according to claim 1, wherein the rollers include a pair of lower rollers rotating in opposite directions and two side rollers, each of the side rollers cooperating with a roller of the pair of lower rollers and being disposed above and to a side of the lower rollers, wherein the non-perforated portions extend along an area between the rollers of the pair of lower rollers and for an arc starting from the area.

7. An apparatus according to claim 1, wherein the grille includes at least two grille sectors, the apparatus further comprising at least one longitudinal blade disposed at an edge formed between the two grille sectors.

8. An apparatus according to claim 7, wherein the blade is disposed at an edge coinciding with an area of cooperation between two rollers rotating in the same direction.

9. An apparatus according to claim 1, wherein the whole portion beneath the slower roller of the two rollers is non-perforated and a non-perforated portion beneath the faster roller of the two rollers extends for an arc up to 60°.

10. An apparatus according to claim 1, wherein the non-perforated portions extend beneath at least one of the at least two cooperating rollers through an arc of at least 60°.

* * * * *